US009770906B2

(12) United States Patent
Smith et al.

(10) Patent No.: US 9,770,906 B2
(45) Date of Patent: Sep. 26, 2017

(54) INK BUILDUP SENSOR ARRANGEMENT

(71) Applicant: VIDEOJET TECHNOLOGIES, INC., Wood Dale, IL (US)

(72) Inventors: Robert Smith, Thrapston (GB); Omer Salhadin, Cambridge (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 15/316,378

(22) PCT Filed: Jun. 4, 2015

(86) PCT No.: PCT/US2015/034161
§ 371 (c)(1),
(2) Date: Dec. 5, 2016

(87) PCT Pub. No.: WO2015/187926
PCT Pub. Date: Dec. 10, 2015

(65) Prior Publication Data

US 2017/0182767 A1 Jun. 29, 2017

Related U.S. Application Data

(60) Provisional application No. 62/008,208, filed on Jun. 5, 2014.

(51) Int. Cl.
*B41J 2/125* (2006.01)
*B41J 2/045* (2006.01)
(Continued)

(52) U.S. Cl.
CPC ..... *B41J 2/125* (2013.01); *B41J 2/02* (2013.01); *B41J 2/085* (2013.01); *B41J 2/09* (2013.01);
(Continued)

(58) Field of Classification Search
CPC .. B41J 29/393; B41J 2/214241; B41J 2/2146; B41J 2/0451; B41J 2/04561;
(Continued)

(56) References Cited

U.S. PATENT DOCUMENTS 4,338,610 A 7/1982 Sellen et al.
4,364,055 A 12/1982 Aiba
(Continued)

FOREIGN PATENT DOCUMENTS

DE 102010016858 A1 11/2011
EP 0531156 A2 3/1993
(Continued)

*Primary Examiner* — Thinh H Nguyen
(74) *Attorney, Agent, or Firm* — Robert L. Wolter; Beusse, Wolter, Sanks & Maire PLLC

(57) ABSTRACT

A continuous ink jet print head (10), including: an ink droplet generator (116) configured to emit an ink droplet (158) along an undeflected droplet flight path (30); a charge electrode (118) configured to impart a charge to the ink droplet; deflector plates (120A, 120B) adjacent the undeflected droplet flight path, downstream from the charge electrode, and configured to deflect the ink droplet to a deflected droplet flight path that lies within a range of deflected flight paths bounded by at least deflected droplet flight path and a most deflected droplet flight path; a gutter (122) configured to receive an ink droplet traveling along the undeflected droplet flight path; and an ink buildup sensor (102) configured to detect an accumulation of ink (140) relative to a droplet flight path disposed within the range of deflected flight paths.

21 Claims, 7 Drawing Sheets

(51) Int. Cl.

| | |
|---|---|
| ***B41J 2/02*** | (2006.01) |
| ***B41J 2/085*** | (2006.01) |
| ***B41J 2/09*** | (2006.01) |
| ***B41J 2/185*** | (2006.01) |

(52) U.S. Cl.
CPC ..... *B41J 2/185* (2013.01); *B41J 2/04561* (2013.01); *B41J 2002/022* (2013.01); *B41J 2002/1853* (2013.01)

(58) Field of Classification Search
CPC .... B41J 2/04526; B41J 2/04586; B41J 2/085; B41J 2/2142; B41J 19/20; B41J 2002/1853; B41J 2/09; B41J 2002/022
See application file for complete search history.

(56) References Cited

U.S. PATENT DOCUMENTS

| | | | | |
|---|---|---|---|---|
| 4,568,947 | A | 2/1986 | Regnault | |
| 4,682,183 | A | 7/1987 | Elchinger et al. | |
| 4,791,434 | A | 12/1988 | Wills | |
| 4,800,398 | A | 1/1989 | Naruse et al. | |
| 4,847,631 | A | 7/1989 | Naruse et al. | |
| 4,990,932 | A | 2/1991 | Houston | |
| 5,030,973 | A | 7/1991 | Nonoyama et al. | |
| 5,160,939 | A | 11/1992 | Bajeux et al. | |
| 5,455,606 | A | 10/1995 | Keeling et al. | |
| 5,455,611 | A | 10/1995 | Simon et al. | |
| 5,491,499 | A | 2/1996 | Bibbe et al. | |
| 5,623,292 | A | 4/1997 | Shrivastava et al. | |
| 5,710,579 | A | 1/1998 | Hahs et al. | |
| 5,793,398 | A | 8/1998 | Hennig | |
| 5,796,419 | A | 8/1998 | Clark et al. | |
| 6,280,023 | B1 | 8/2001 | Ufkes | |
| 6,357,860 | B1 | 3/2002 | Rhodes | |
| 6,464,322 | B2 | 10/2002 | Dunand | |
| 6,467,880 | B2 | 10/2002 | Rhodes | |
| 6,607,257 | B2 | 8/2003 | Szumla et al. | |
| 6,622,266 | B1 | 9/2003 | Goddard et al. | |
| 6,712,451 | B2 | 3/2004 | Madziarz et al. | |
| 6,726,298 | B2 | 4/2004 | Anderson et al. | |
| 6,866,367 | B2 | 3/2005 | Szumla | |
| 6,866,370 | B2 * | 3/2005 | Jeanmaire | B41J 2/03 347/77 |
| 7,346,086 | B2 | 3/2008 | Ryan et al. | |
| 7,393,085 | B2 | 7/2008 | Lecheheb et al. | |
| 8,449,054 | B2 | 5/2013 | Harris et al. | |
| 8,454,128 | B2 | 6/2013 | Fishkin et al. | |
| 8,474,930 | B2 | 7/2013 | Rasmussen | |
| 2003/0081040 | A1 * | 5/2003 | Therien | B41J 2/12 347/19 |
| 2005/0110836 | A1 | 5/2005 | Colombat et al. | |
| 2007/0064068 | A1 | 3/2007 | Piatt | |
| 2008/0170108 | A1 | 7/2008 | Lee et al. | |
| 2008/0284835 | A1 | 11/2008 | Panchawagh | |
| 2009/0033727 | A1 | 2/2009 | Anagnostopoulos et al. | |
| 2009/0120512 | A1 | 5/2009 | Berry et al. | |
| 2010/0045758 | A1 | 2/2010 | Okazawa | |
| 2010/0238243 | A1 | 9/2010 | Tomlin et al. | |
| 2011/0316933 | A1 | 12/2011 | Fishkin et al. | |
| 2013/0057904 | A1 | 3/2013 | Soto et al. | |

FOREIGN PATENT DOCUMENTS

| | | | |
|---|---|---|---|
| EP | 0805037 | A2 | 4/1997 |
| EP | 0780231 | A1 | 6/1997 |
| EP | 1093918 | B1 | 4/2001 |
| EP | 0813974 | B1 | 3/2003 |
| EP | 1013458 | | 8/2003 |
| EP | 1847391 | A1 | 10/2007 |
| EP | 2082883 | A2 | 7/2009 |
| EP | 2393054 | A1 | 7/2011 |
| EP | 2555113 | A1 | 6/2013 |
| FR | 2636884 | A1 | 3/1990 |
| GB | 2447919 | A | 10/2008 |
| GB | 2479751 | A | 10/2011 |
| JP | 5896561 | | 6/1983 |
| JP | 00187556 | | 9/1985 |
| JP | 2000229419 | | 8/2000 |
| WO | 9706009 | A1 | 2/1997 |
| WO | 9828146 | A1 | 7/1998 |
| WO | 02100645 | | 12/2002 |
| WO | 2008050141 | A1 | 5/2008 |
| WO | 2009049130 | A1 | 4/2009 |
| WO | 2015187839 | A1 | 12/2015 |
| WO | 2015187926 | A1 | 12/2015 |
| WO | 2015187983 | A2 | 12/2015 |

* cited by examiner

INK BUILDUP SENSOR ARRANGEMENT

FIELD OF THE INVENTION

The present disclosure relates to ink jet printing and, more particularly, to a sensor arrangement for detecting a buildup of ink on surfaces adjacent to ink droplets in flight.

BACKGROUND OF THE INVENTION

In ink jet printing systems a printed image is made up of individual droplets of ink generated at a nozzle and propelled towards a substrate. There are two principal systems: drop on demand where ink droplets for printing are generated as and when required; and continuous ink jet printing in which droplets are continuously produced and only selected ones are steered towards the substrate, the others being recirculated back to an ink supply.

Continuous ink jet printers supply pressurized ink to a print head drop generator where a continuous stream of ink emanating from a nozzle is broken up into individual regular drops by, for example, an oscillating piezoelectric element. The drops are steered past a charge electrode where they are selectively and separately given a predetermined charge before passing through a transverse electric field provided across a pair of deflection plates, including a high voltage plate and a zero/negative voltage plate. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and a position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix including a regular array of potential drop positions. Each matrix comprises a plurality of columns (strokes), each being defined by a line including a plurality of potential drop positions (e.g., seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

As the ink is ejected from the print head assembly, it is deposited on the substrate. However, ink in the form of ink mist or droplets may instead land on a surface proximate a flight path envelope of the ink droplets, such as an outer surface of the gutter. Over time this ink may accumulate and eventually protrude into the flight path envelope where it becomes an obstacle to the ink droplets closest to the accumulated ink. An ink-droplet that encounters the accumulated ink may be blocked and/or deflected from its intended flight path, and thus the intended print is not achieved. This can eventually lead to a shutdown of the printing process.

BRIEF SUMMARY

The present disclosure provides a sensor arrangement for detecting a buildup of ink on surfaces adjacent to ink-droplets in flight. In embodiments, the unique sensor arrangement uses a reduction in sensed light to ascertain whether there is an accumulation of ink on an internal surface of a print head.

In one aspect, a continuous ink jet print head includes an ink droplet generator configured to emit ink droplets along a droplet flight path and a charge electrode configured to impart a charge to the ink droplets. Deflector plates are disposed adjacent the droplet flight path, downstream from the charge electrode, and configured to deflect some of the ink droplets to a deflected droplet flight path. A gutter is configured to receive ink droplets. An ink buildup sensor is configured to detect an accumulation of ink on a print head surface via a change in an amount of light sensed by the ink buildup sensor.

In another aspect, an ink droplet generator is configured to emit ink droplets along a droplet flight path. A charge electrode is configured to impart a charge to the ink droplets. Deflector plates are disposed adjacent the droplet flight path, downstream from the charge electrode, and configured to deflect some of the ink droplets to a deflected droplet flight path. A gutter is configured to receive ink droplets. An ink buildup sensor is configured to detect an accumulation of ink on a print head surface via a change in an amount of light sensed by the ink buildup sensor.

In another aspect, a continuous ink jet print head includes an ink droplet generator configured to emit an ink droplet along an undeflected droplet flight path and a charge electrode configured to impart a charge to the ink droplet. Deflector plates are disposed adjacent the undeflected droplet flight path, downstream from the charge electrode, and configured to deflect the ink droplet to a deflected droplet flight path that lies within a range of deflected flight paths bounded by a least deflected droplet flight path and a most deflected droplet flight path. A gutter is configured to receive an ink droplet traveling along the undeflected droplet flight path. An ink buildup sensor is configured to detect an accumulation of ink relative to a droplet flight path disposed within the range of deflected flight paths via a change in an amount of light sensed by the ink buildup sensor.

In another aspect, method of operating an ink jet print head includes emitting ink droplets from an ink droplet generator along an undeflected droplet flight path; using a charge electrode to impart a charge to some of the ink droplets; deflecting some of the ink droplets to a deflected droplet flight path using deflector plates adjacent the undeflected droplet flight path; and collecting in a gutter ink droplets traveling along the undeflected droplet flight path. An optical sensor is used to detect ink buildup on an area adjacent the gutter. The optical sensor infers an accumulation of ink that grows in a direction toward an ink droplet in flight on the deflected droplet flight path by sensing a reduction in light received by the optical sensor.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

The invention is explained in the following description in view of the drawings that show.

DETAILED DESCRIPTION OF THE INVENTION

The present disclosure provides a buildup sensor arrangement that can detect unwanted ink accumulation on an interior surface of a print head of a continuous inkjet printer. Using the new and unique buildup sensor arrangement the buildup can be detected before it interferes with print quality, or causes an EHT trip due to arcing caused by the high voltages present in the extra high tension deflector plate. As a result, a notification can be generated, the printing operation can be stopped, and/or the accumulation can be automatically cleaned before the accumulation builds to a point where it interferes with the print quality. The disclosed ink build up sensor can be used with any type of continuous inkjet system, including single nozzle, dual nozzle, multi nozzle, and binary array systems.

Figure 1:
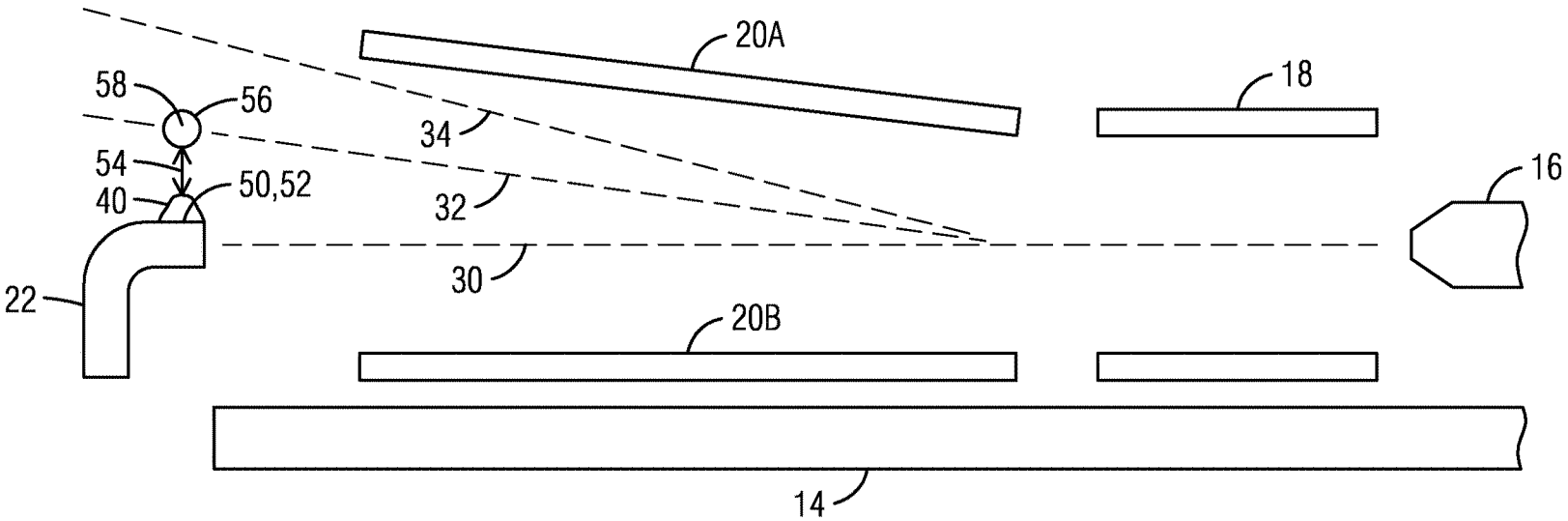
FIG. 1 shows a schematic representation of a print head of a conventional continuous ink jet printer.

FIG. 1 schematically shows a side view of a conventional continuous ink jet print head 10 having a deck 14, an ink droplet generator 16, a charging electrode assembly 18, a high voltage deflector plate 20A, a zero or negative volt deflection plate 20B, and a gutter tube 22. In operation the ink droplet generator 16 generates ink droplets and emits each droplet such that each droplet begins traveling along an undeflected droplet flight path 30. Each droplet passes through the charge electrode assembly 18 where each droplet may receive a charge. The charge is associated with an amount of deflection the droplet is to undergo as the droplet continues past the deflection plates 20A, 20B. If the droplet receives no charge or negligible charge the droplet will continue along its original, undeflected droplet flight path 30, enter an inlet of the gutter tube 22, and eventually return to an ink well (not shown).

If the droplet receives a charge the droplet will be deflected to a deflected droplet flight path. The deflected droplet flight path may be any flight path within a range of flight paths bounded by a least deflected droplet flight path 32 and a most deflected droplet flight path 34. These deflected flight paths correspond to a minimum and maximum height of a print that results from the ink droplets subsequently landing on a substrate. All other (intended) flight paths for printed droplets will be between the least deflected droplet flight path 32 and the most deflected droplet flight path 34.

During operation an ink droplet may not travel along its flight path as intended, and/or ink mist may be formed, and the ink mist and/or droplet may deposit on an interior surface of the print head 10. Repeated deposits may grow over time to form an accumulation of ink 40. In the configuration shown in FIG. 1 a location particularly prone to accumulation of ink 40 is a droplet side 50 of an external surface 52 of the gutter tube 22 adjacent the gutter inlet. The droplet side 50 of the external surface 52 is generally disposed between the undeflected droplet flight path 30 and the least deflected droplet flight path 32. As a result of the particulars of this location, any anomalously under-deflected ink droplet may actually be steered toward the droplet side 50 of the external surface 52, thereby actively, though unintentionally, contributing to an ink accumulation in this location.

A clearance 54 exists between a surface 56 of an ink droplet 58 traveling along the least deflected droplet flight path 32 and the nearest object. When there is no accumulation of ink 40 the nearest object is the external surface 52 and the clearance 54 is therefore the largest it can be. When there is an accumulation of ink 40 the nearest object is the accumulation of ink 40 and hence the clearance 54 is reduced.

Monitoring for the accumulation of ink 40 on the droplet side 50 of the external surface 52 may be accomplished by transmitting light through the clearance 54. A controller can be programmed to compare an amount of light that is received during operation with a reference amount of light received when there is no accumulation of ink 40. For example, the controller can be programmed to access a lookup table that has data including light intensity received and an associated clearance available. The controller may be any suitable controller known in the art and will typically include a processor and memory. There may also be data associated with a threshold clearance which, if reached or surpassed, causes a signal to be generated that indicates a cleaning is needed.

Figure 2:
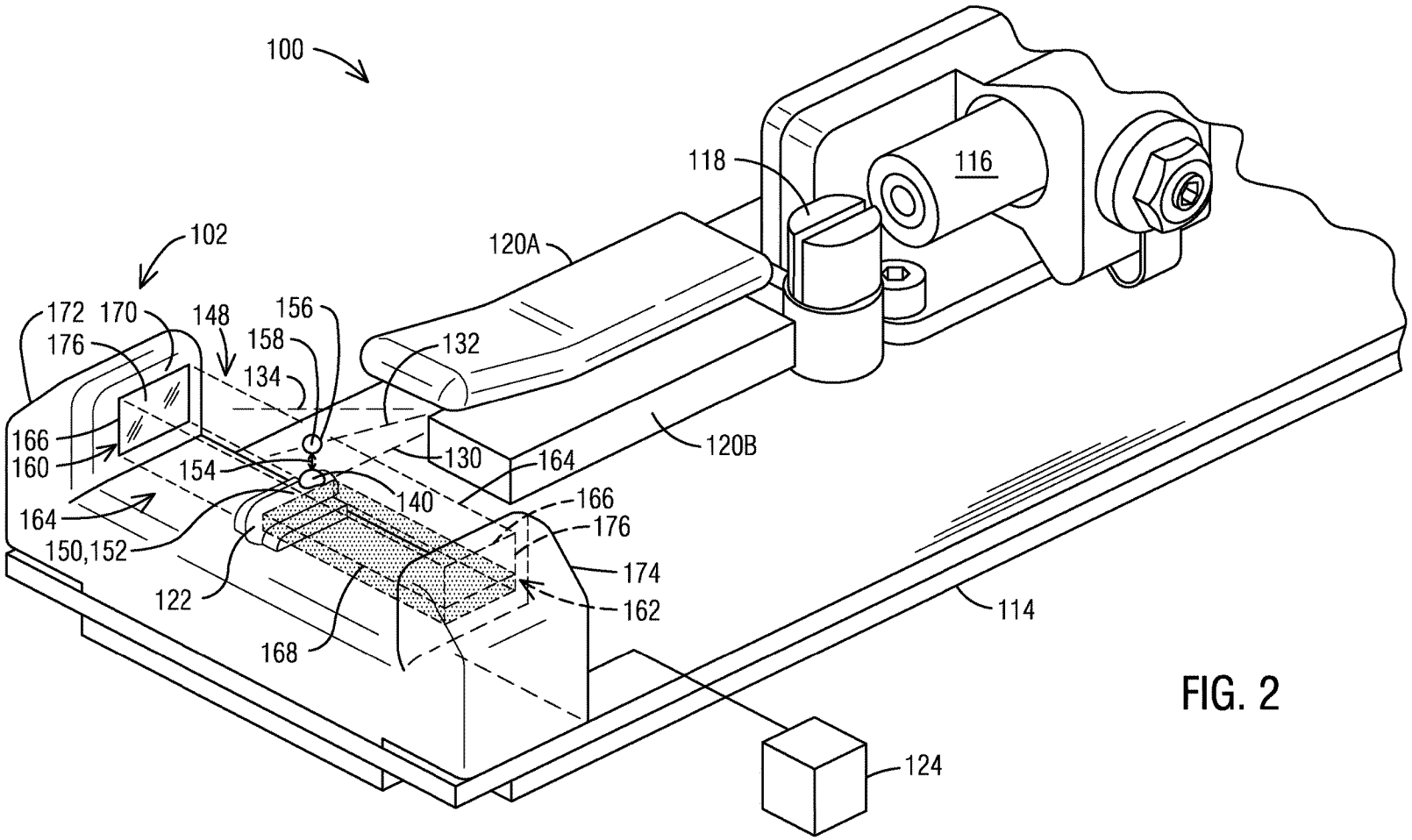
FIG. 2 shows an exemplary embodiment of the buildup sensor and print head arrangement.

FIG. 2 details an exemplary embodiment of an ink buildup sensor and print head arrangement 100 disclosed herein that includes an ink buildup sensor 102, a deck 114, an ink droplet generator 116, a charge electrode assembly 118, a high voltage deflector plate 120A, a zero or negative voltage deflection plate 120B, a gutter tube 122, and a controller 124 located in an electronics cabinet (not shown). During printing operation the ink droplets may travel along a flight path that lies within a range of flight paths bounded by a least deflected droplet flight path 132 and a most deflected droplet flight path 134. Ink droplet(s) and/or mist may deposit on an interior surface of the print head and grow over time to form an accumulation of ink 140. Any interior surface onto which ink could accumulate enough to interfere with an ink droplet in flight towards a substrate may be monitored including those interior surfaces downstream of the ink droplet generator 116. Each relevant surface will define at least part of a boundary of an internal volume 148 of the print head downstream of the ink droplet generator 116. On the other hand, if an accumulation of ink 140 growing on a surface would not interfere with an ink droplet in flight towards a substrate, such as an accumulation on an interior surface of the gutter tube 122, then that surface would be a surface not monitored by the ink buildup sensor 102. In this exemplary embodiment a droplet side 150 of an external surface 152 of the gutter tube 122 may be closely monitored by the ink buildup sensor 102. Alternately, or in addition, various other surfaces could be located elsewhere and likewise monitored individually or simultaneously.

The ink buildup sensor 102 may include a light emitting end having a light emitting area 160 configured to emit light toward a light gathering end having a light gathering area 162. The light may be in the visible, infrared, or ultraviolet range, or combinations thereof. As used herein, a light path 164 is a volume between the light emitting area 160 and the light gathering area 162 that conforms to their perimeters 166 as though nothing were present that could block light. Anything disposed in the light path 164 would create a blocked portion 168 of the light path 164.

Since an objective is to determine whether ink is accumulating toward an ink droplet in flight toward a substrate, and since it is known that the droplet side 150 of the external surface 152 of the gutter tube 122 is close to the least deflected droplet flight path 132, the ink buildup sensor 102 may be configured such that light to be gathered by the light gathering area 162 traverses a clearance 154 between a surface 156 of an ink droplet 158 traveling on the least deflected droplet flight path 132 and a nearest object. When there is no accumulation of ink 140 the nearest object is the droplet side 150 of the external surface 152. If there is an accumulation of ink 140, then the accumulation of ink 140 is the nearest object.

Monitoring this clearance 154 allows for notice of an accumulation of ink 140 before the accumulation of ink 140 grows to the point where it reaches an ink droplet 158 in flight toward a substrate and actually begins to interfere with the printing operation. This is because any ink that does accumulate on the droplet side 150 of the gutter tube 122 would block some of the emitted light that would otherwise traverse the clearance 154.

The controller 124 can be programmed to compare an amount of light that is received during operation with a reference amount of light received when there is no accumulation of ink 140. For example, the controller 124 can be programmed to access a lookup table that has data including light intensity received and an associated clearance available. The controller can account for any external light source, such as by being programmed to ignore light other than that of the LED light emitter. This can be done in any way known to those in the art. For example, a pattern can be assigned to the emitted light so that light present in between light bursts from the light emitter can be accounted for as light pollution and subtracted out. There may also be data associated with a threshold clearance which, if reached or surpassed, causes a signal to be generated that indicates a cleaning is needed. An example threshold clearance may be 150 microns. If the reduction in light received indicates that the clearance has fallen below 150 microns, then the controller 124 may signal that a cleaning is necessary and hence it would not take a large accumulation of ink 140 to interfere with the ink droplet 158 in flight toward a substrate. In addition, the emitted light may be visible light, but it may also be ultraviolet light, infrared light, or any form of electromagnetic radiation that may be blocked by the accumulation of ink 140.

In addition to being able to detect a magnitude of an existing accumulation of ink 140, the controller 124 may be programmed to predict when an accumulation of ink 140 will exceed a certain threshold. For example, the controller 124 may determine a size of an accumulation of ink 140 at some point in time and may then use known parameters and/or determine a rate of growth of the accumulation of ink 140. Once the current size and rate of growth of the accumulation of ink 140 are known, the controller can then predict when the size of the accumulation of ink 140 will exceed a predetermined threshold. The controller 124 is configured to predict when maintenance might be necessary and generate a signal indicative of a recommended maintenance time. In this manner the controller 124 provides advance notice, which the operator may use to plan appropriate maintenance. This, in turn, may save time and/or expense. For example, if a production line is to be shut down for another reason, knowing that maintenance will be coming due soon may prompt the user to perform the needed maintenance during an already-scheduled shutdown. This helps avoid additional downtime that might occur if the operator were not so informed and a problem with the accumulation of ink 140 developed shortly after the scheduled shutdown.

To perform a predictive maintenance function the controller 124 may include or be configured to access a database in the form of a lookup table that includes data for a make and model print head 10 and/or type of ink associated with a print head 10 run time. The database may be within the memory of the printer or at a location remote from the printer. For example, for a particular model of print head 10 and/or type of ink the lookup table includes data for a predetermined run time (X hours) after which maintenance is recommended. The recommended time may also be based on the ambient environmental conditions of the printer, such as the temperature, humidity, and dust conditions. The controller may be configured to generate warning/notice signals within prescribed time durations before the run time has elapsed. In addition, or alternatively, the controller 124 and/or print head 10 may be configured to count ink drops, which may include the number of ink droplets 58 generated. The number of ink droplets 58 may include the number of charged droplets, uncharged droplets or both. An ink drop count may be different for different models of print heads or different type inks. In addition, the run time or the ink drop count may differ depending whether the print head is brand new or depending on the number of ink build up maintenance operations that have been performed on a particular print head. The predictive maintenance may be determined on historical data associated with a particular print head 10, or a fleet of print heads of a similar make and model. For example, in the embodiment described above, the processor considers the amount of time it takes for the build up to reach the threshold level, and/or the number of drops it takes to reach the threshold etc. Such data may be recorded for a number of the same types of print heads and/or ink types to arrive at a run time and/or ink drop count to populate a lookup table.

The ink buildup sensor 102 may be configured such that the surface to be monitored may be disposed directly in the light path 164 between the light emitting area 160 and the light gathering area 162 (as shown) such that some of the light is blocked even if there is no accumulation of ink 140. In such a configuration an accumulation of ink 140 on the surface to be monitored will relatively promptly and relatively significantly reduce an amount of light that reaches the light gathering area 162. This reduction may be the result of the accumulation physically blocking some of the light being emitted by the light emitting area 160, and/or it may be the result of the accumulation reducing an amount of reflected light, etc. Whatever the mechanism behind the reduction in light, the light gathering area 162 will gather a progressively reduced amount of light as the ink accumulates over time. Upon reaching a threshold amount of reduction an indication of the condition can be generated.

Alternately, the ink buildup sensor 102 may be configured such that light may travel adjacent to the surface to be monitored such that the surface does not interfere (not shown) with a light path 164 the light takes between the light emitting area 160 and the light gathering area 162. In such a configuration the light path 164 will be positioned such that an accumulation of ink 140 on the surface to be monitored will eventually reduce an amount of light that reaches the light gathering area 162, but any initial accumulation may be relatively less prompt and relatively less noticeable. Regardless of the initial design, the initial amount of light that reaches the light gathering area 162, and whether the reduction in light gathered by the light gathering area 162 is due to a direct blockage of the light path 164 and/or a reduction of reflections, the ink buildup sensor 102 will "recognize" a reduction in light when there is an accumulation of ink 140 on the surface(s) being monitored when compared to an amount of light gathered when there is no accumulation of ink 140.

In an alternate exemplary embodiment, the light emitting area 160 could be dispensed with and an initial amount of ambient light gathered by the light gathering area 162 can be determined. Any reduction from this initial amount of light gathered can be taken as an indication of the presence of an accumulation of ink 140. For example, the light gathering area 162 could be disposed directly adjacent the surface to be monitored, such as the droplet side 150 of the gutter tube 122. In this instance the spatter/mist, etc., could cover the light gathering area 162 and cause the reduction in ambient light gathered.

In the exemplary embodiment shown the ink buildup sensor 102 may include a sensor housing 170 which may be made of any suitable material such as polyphenylene sulfide (PPS). The sensor housing 170 may have a light emitting end 172 configured to secure the light emitting area 160, and a light sensing end 174 configured to secure the light gathering area 162. A light emitter (not shown) emits light that is eventually emitted through the light emitting area 160. A light or optical detector (not shown) senses the light that is gathered by the light gathering area 162. The light emitting area 160 and the light gathering area 162 define the light path 164 and the gutter tube 122 extends into the light path slightly, creating the blocked portion 168 of the light path 164. An amount of light that is gathered by the light gathering area 162 and then sensed by the light detector when there is no accumulation of ink 140 can be determined. Should any ink accumulate on the droplet side 150 of the gutter tube 122 it will further block the clearance 154 and hence reduce an amount of light the light detector senses when compared to the amount of light sensed when there is no accumulation of ink 140. This reduction in the amount of light will be considered an indication of an accumulation of ink 140. In this configuration the indicator is considered a direct indicator because the reduction in light sensed would be a direct result of an accumulation of ink 140 oriented toward the ink droplet 158 in flight toward a substrate.

In a variation of this configuration the gutter tube 122 may be positioned such that it does not protrude into the light path 164, but instead is positioned such that the droplet side 150 of the gutter tube 122 is slightly farther from the light path 164. This may simply be a matter of design choice. In such an exemplary embodiment an initial ink accumulation would reduce the amount of light gathered by the light gathering area 162 to a lesser degree than if the droplet side 150 were closer because clearance 154 would be larger and thus the minimal accumulation would block a smaller portion of the clearance 154. In either this or the previous exemplary embodiment the ink buildup sensor 102 will be able to sense a reduction in light gathered by the light gathering area 162 when an accumulation decreases the amount of direct or reflected light that passes through the clearance 154. Hence, the ink buildup sensor 102 will be able to sense when an accumulation of ink 40 exists on the droplet side 150.

Figure 3:
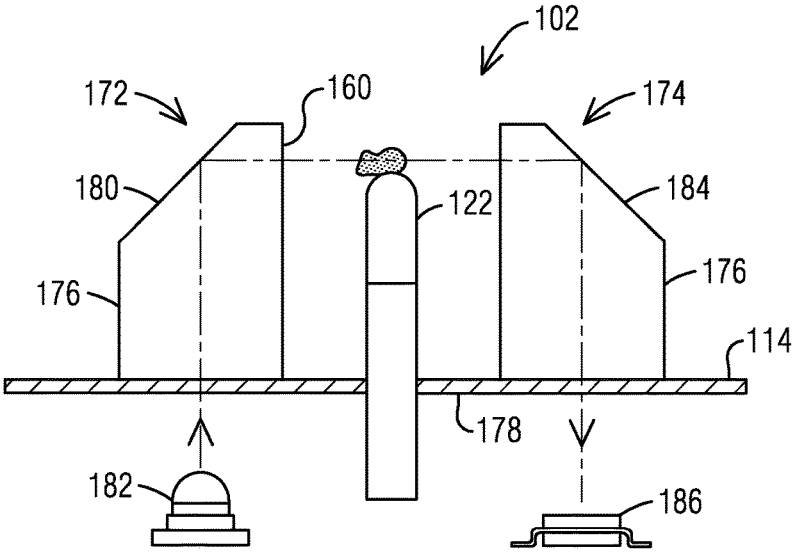
FIG. 3 shows a schematic representation of the ink buildup sensor of FIG. 2.

FIG. 3 is a schematic representation of the ink buildup sensor 102 of FIG. 2, showing an emitter reflector 180 in the light emitting end 172, which acts as a transparent cover 176 for a light emitter 182 and is configured to receive and light emitted by the light emitter 182, reflect the light toward the light sensing end 174, and emit the reflected light out of the light emitting area 160 of its external surface. Any suitable light source can be used, such as an LED. The sensor housing 170 also secures sensor reflector 184 in the light sensing end 174. The sensor reflector 184 acts as a transparent cover 176 for a light detector 186 and is configured to gather light emitted by the light emitting area 160 via the light gathering area 162 of its external surface, and reflect and deliver the gathered light toward the light detector 186.

Any suitable optical sensor can be used, such as a photodiode. The light detector may be more sophisticated. For example, a linear array sensor may be used, or an image sensor may be used. A CCD device or camera may be used. In this manner the amount of light that reaches the light detector 186 may be determined by an intensity of the light and/or a determination of which individual sensors of the array of sensor is no longer receiving light or is receiving less light than other individual sensors. In this manner the light detector 186 could be used to determine not only an amount of light that reaches the light detector 186, but the light detector 186 could also be used to determine a shape of the shadow formed by the accumulation of ink 140. From this a shape of the accumulation of ink 140 itself could be inferred and this shape may be used when assessing the threat the accumulation of ink 140 poses to the printing process.

Figure 4:
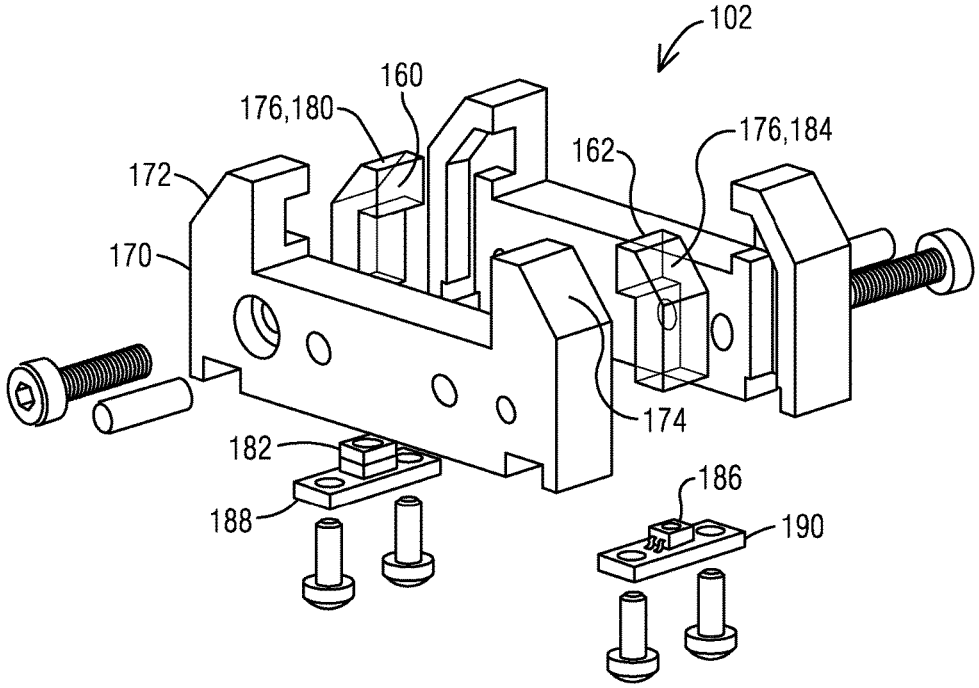
FIG. 4 shows an exemplary embodiment of the buildup sensor of FIG. 2.

FIG. 4 shows a configuration of the exemplary embodiment of the ink buildup sensor 102 of FIG. 2, showing the light emitting end 172, the light sensing end 174, the transparent covers 176, the emitter reflector 180, the light emitter 182, the sensor reflector 184, the light detector 186, as well as the sensor housing. The light emitter 182 may be disposed on an emitter printed circuit board 188 and the light detector 186 may be disposed on a sensor printed circuit board 190.

Figure 5:
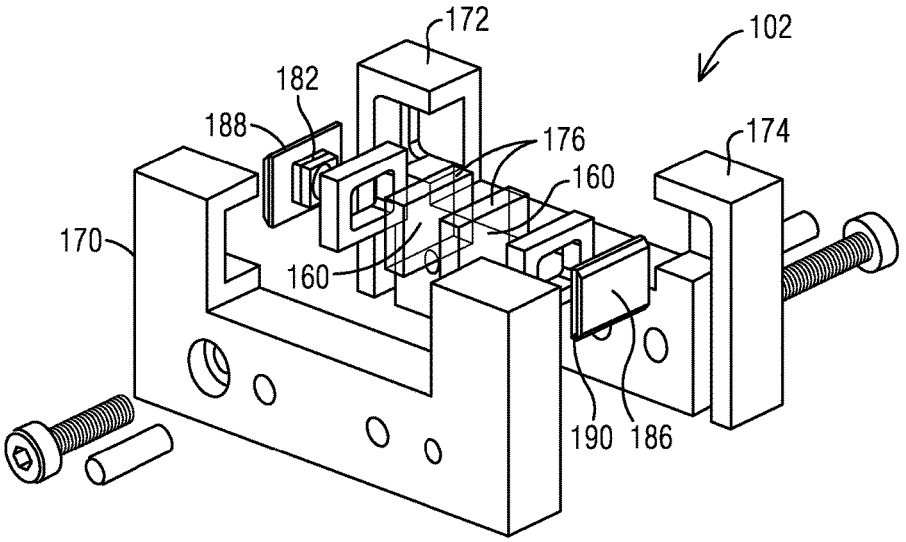
FIG. 5 shows an alternate exemplary embodiment of the buildup sensor.

FIG. 5 shows a configuration of an alternate exemplary embodiment of the ink buildup sensor 102. In this exemplary embodiment the light emitter 182 and the light detector 186 have been reoriented in a manner that eliminates the need for reflection/redirection of the emitted light. The light emitter 182 is disposed in the light emitting end 172 and oriented in-line with the light path 164. Emitted light will travel through the transparent cover 176 and out the cover's light emitting area 160 on its way to the light sensing end 174. Likewise, the light detector 186 is disposed in the light sensing end 174 and is oriented in-line with the light path 164. Emitted light is gathered by the light gathering area 162 which is integral to the transparent cover 176 and then travels through the transparent cover 176 after which it is sensed by the light detector 186.

Figure 6:
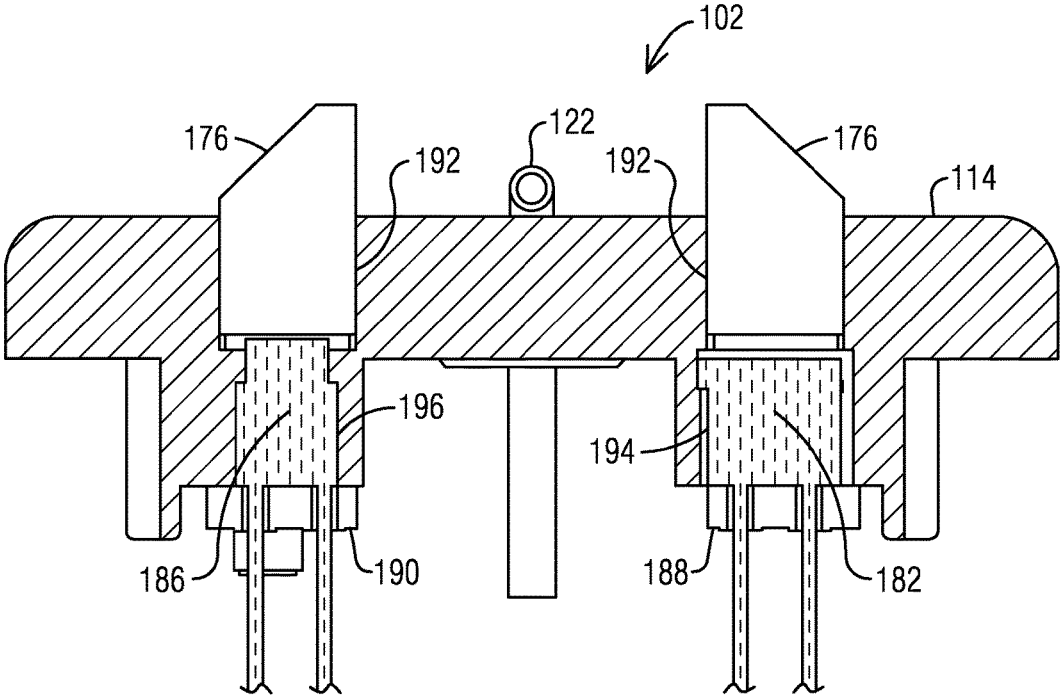
FIG. 6 shows a schematic representation of an alternate exemplary embodiment of the ink buildup sensor.

FIG. 6 is a schematic representation of an alternate exemplary embodiment of the ink buildup sensor 102, as seen from the perspective of an ink droplet 58 traveling along the undeflected droplet flight path 30 into the gutter tube 122. In this exemplary embodiment the transparent covers 176 are positioned within respective recesses 192 in the deck 114. Similarly, the light emitter 182 is disposed within a light emitter recess 194 and the light detector 186 is disposed within a light detector recess 196. This configuration minimizes alignment issues that may result from, for example, tolerance stack-up.

Figure 7:
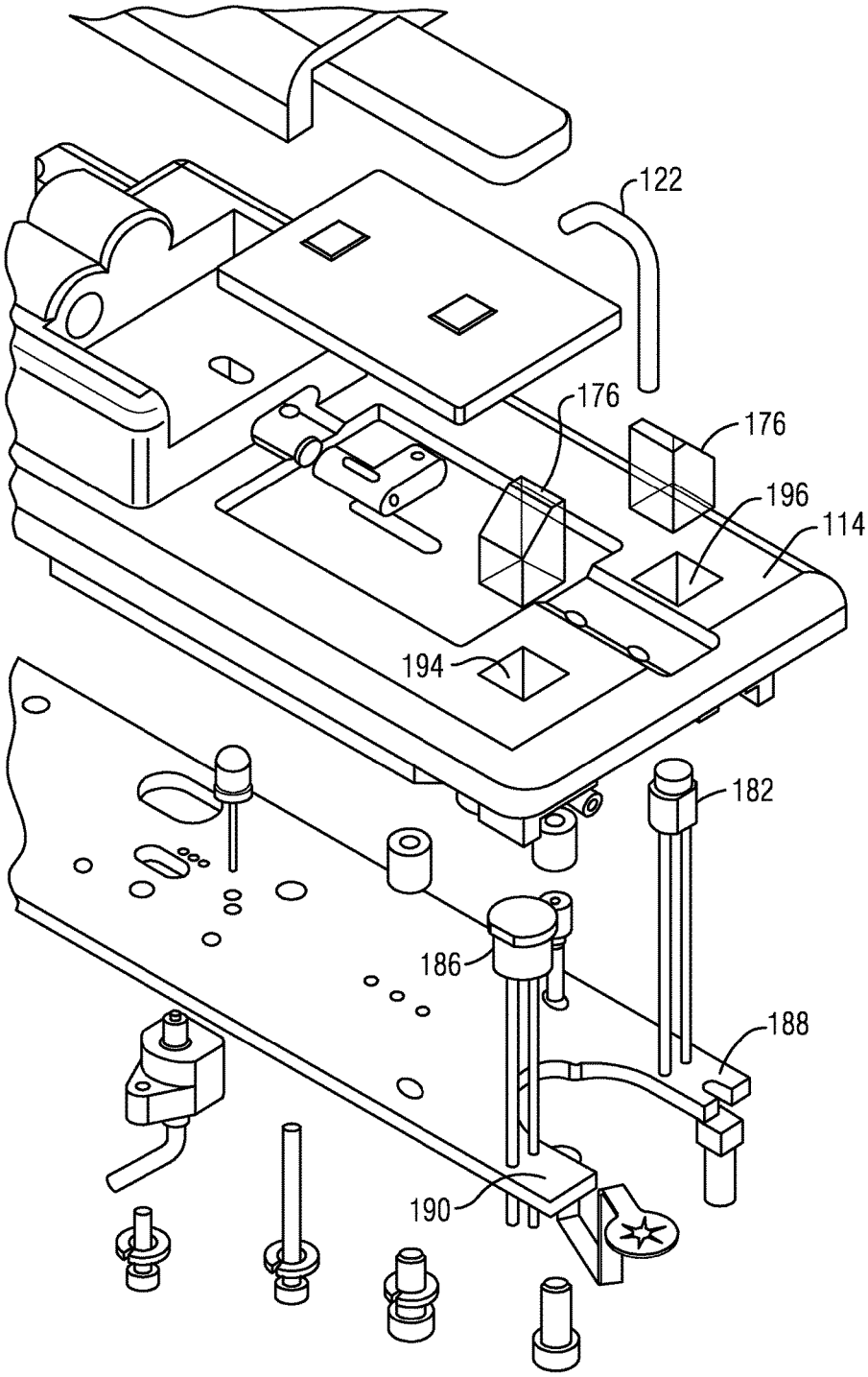
FIG. 7 shows an alternate exemplary embodiment of the ink buildup sensor of FIG. 6.

FIG. 7 shows a configuration of the alternate exemplary embodiment of FIG. 6. In this configuration the locations of the light emitter 182 and the light detector 186 have been swapped to show that the light can travel in either direction as desired. In this configuration the emitter printed circuit board 188 and the sensor printed circuit board 190 are the same board.

Figure 8:
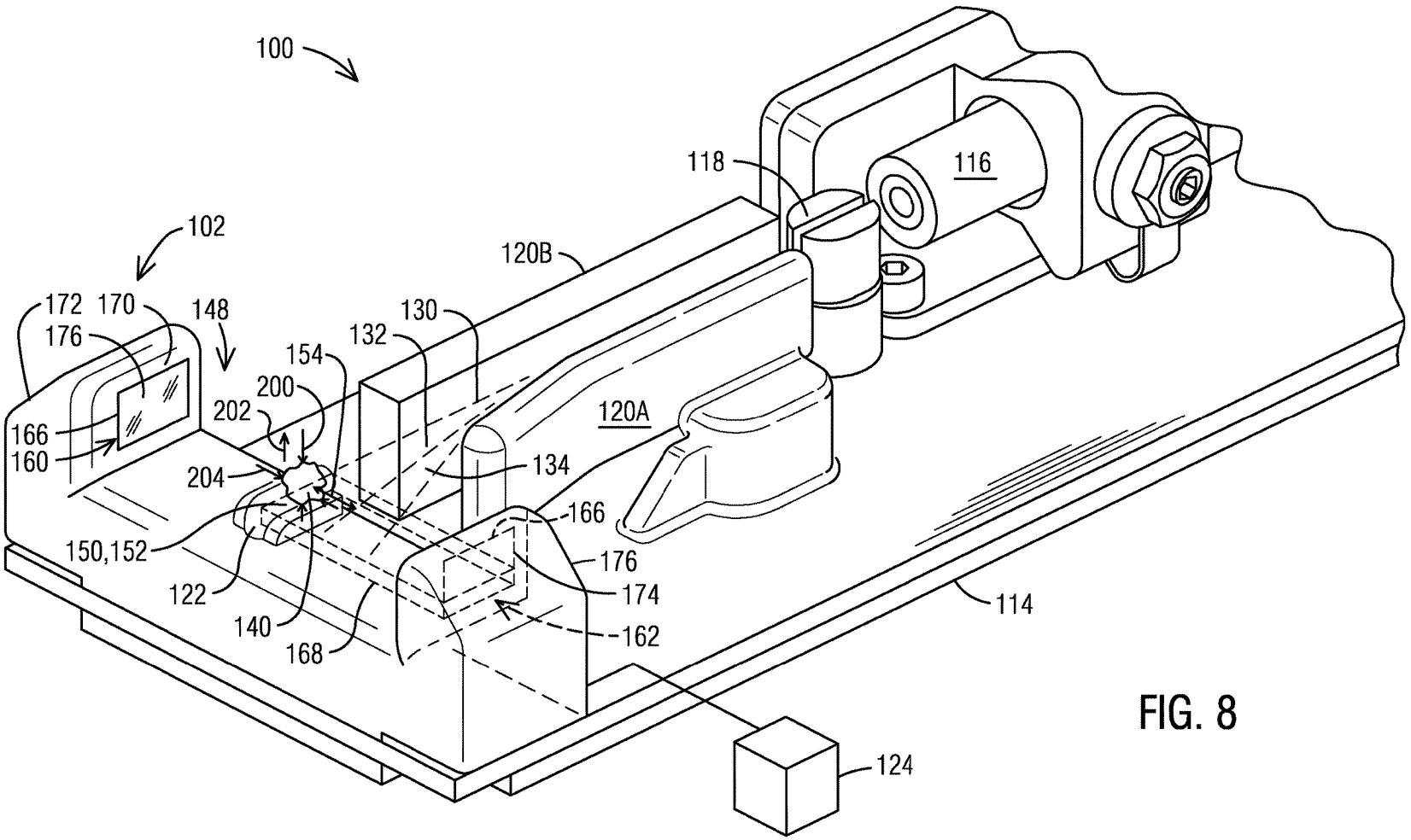
FIG. 8 shows an alternate exemplary embodiment of the buildup sensor and print head arrangement.

FIG. 8 shows an alternate exemplary embodiment of an ink buildup sensor and print head arrangement 100. Unlike the exemplary embodiment of FIG. 2 where the deflection of the ink droplet 158 is perpendicular to and away from the deck 114, deflection of the ink droplet 158 in this exemplary embodiment is parallel to the deck 114. The droplet side 150 of the gutter tube 122 thus is moved ninety degrees so that it is in the three o'clock position in this view, as opposed to the twelve o'clock position of the exemplary embodiment of FIG. 2. In this exemplary embodiment the gutter tube 122 may be disposed such that it extends into the light path 164, but alternately it may not, and in that circumstance the same principles disclosed below would still be applicable.

Ink accumulation toward an ink droplet 158 in flight toward a substrate is still a concern, but due to the arrangement accumulation in this direction (toward the three o'clock position) falls into the blocked portion 168 of the light path 164. Consequently, it is not possible to transmit light through the clearance 154 as is done in the exemplary embodiment of FIG. 2, and hence not possible to directly determine if there is an accumulation of ink 140 toward the ink droplet 158 in flight to a substrate. However, an accumulation typically grows wider as it grows taller, similar to a pyramid shape. Thus, if there is an accumulation of ink 140 oriented toward the ink droplet 158 in flight to a substrate (i.e., oriented parallel to the deck 114, or growing toward the deck 114), a base 200 of the accumulation is likely to extend in direction 202 that is perpendicular to the deck 114 when a height 204 is oriented toward the ink droplet 158 in flight to a substrate. The base 200 of the accumulation of ink 140 will block some of the light emitted by the light emitting area 160 and the reduction in the amount of received light will be taken as an indication that there is an accumulation of ink 140 on the gutter tube 122. In this configuration it can be inferred that the light reduction is from the base 200 of an accumulation of ink 140 that is oriented toward the ink droplet 158 in flight to a substrate. In this arrangement the accumulation of ink 140 toward the ink droplet 158 in flight to a substrate is indirect, but nonetheless it is still effective.

Figure 9:
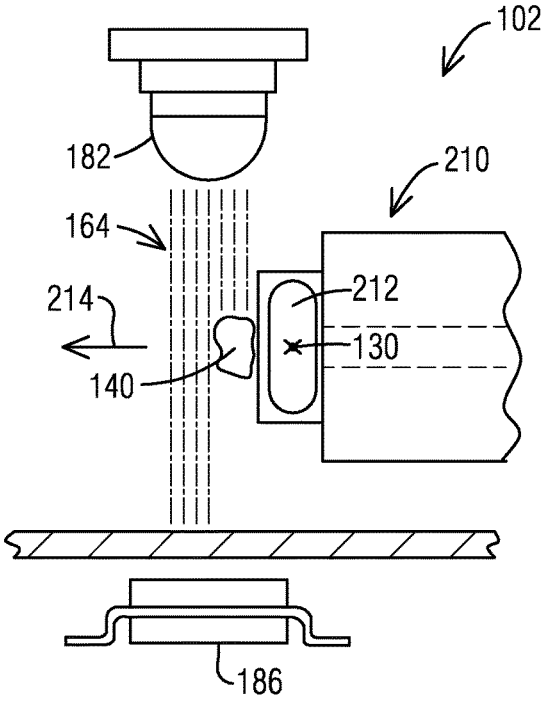
FIG. 9 shows an alternate exemplary embodiment of the buildup sensor.

FIG. 9 is a schematic representation of an alternate exemplary embodiment of the ink buildup sensor 102, as seen from the perspective of an ink droplet 58 traveling along the undeflected droplet flight path 30. In this exemplary embodiment, the gutter includes a gutter block 210 instead of the gutter tube 122. The gutter block 210 may be made of any suitable material, including stainless steel, and includes a gutter opening 212 which may be any suitable shape. In this exemplary embodiment the gutter opening 212 is elongated vertically, transverse to a direction 214 in which ink droplets 158 may be deflected. Accordingly, over time the accumulation of ink 140 may grow in the direction 214. In this exemplary embodiment the light emitter 182 is disposed on an opposite side of the gutter block 210 than the light detector 186. Further, the light emitter 182 is positioned above the light detector 186 such that the light path 164 is transverse to the direction 214. Here the light detector 186 is below the gutter block 210, but the locations of the light emitter 182 and the light detector could readily be reversed.

Figure 10:
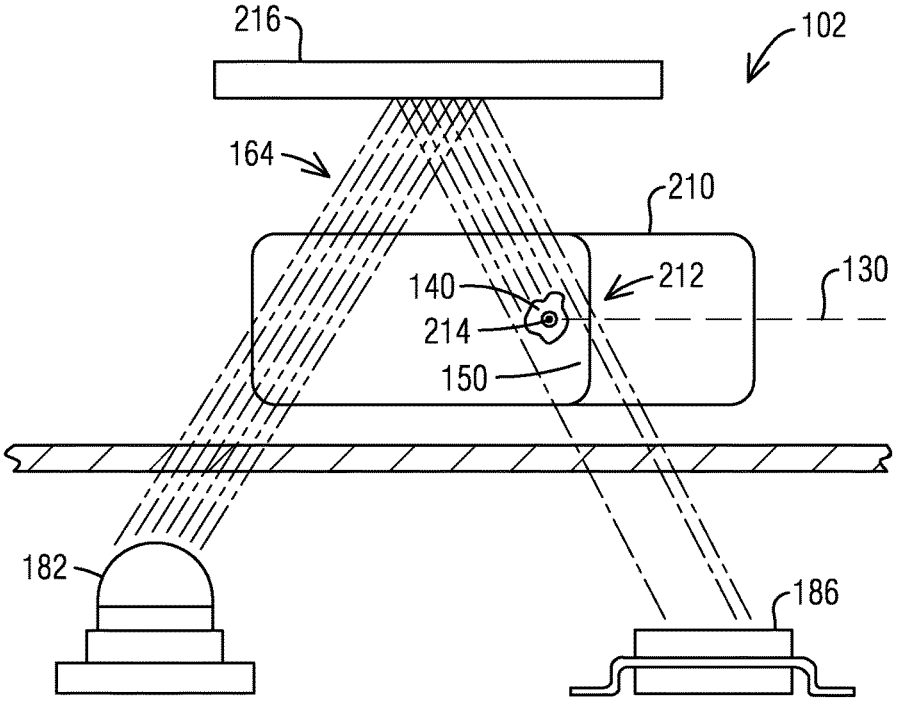
FIG. 10 shows an alternate exemplary embodiment of the buildup sensor.

FIG. 10 is a schematic representation of an alternate exemplary embodiment of the ink buildup sensor 102 as seen from the side (looking from a deflected flight path toward the gutter block 210). Accordingly, over time the accumulation of ink 140 may grow in the direction 214 (out of the page). In this exemplary embodiment both the light emitter 182 and the light detector 186 are disposed on the same side of the gutter block 210. A reflector 216 is positioned above the light detector 186 such that the light path 164 is reflected toward the light detector 186 and passes by the droplet side 150 of the gutter block 210. Thus, any as the in builds up over time the amount of light received by the light detector 186 will be decreased.

From the foregoing it can be seen that the present disclosure provides a unique sensor arrangement that uses a reduction in sensed light to ascertain whether or not there is an accumulation of ink on an internal surface of a print head. The internal surface of the print head can be any desired surface, including the gutter entrance area, the exterior of the gutter adjacent the entrance, either of the deflection electrodes, the nozzle deck, or other surfaces adjacent the gutter entrance, gutter exterior surface, or the deflection electrodes. The exemplary embodiments disclosed represent only two possible configurations. The sensor arrangement can take any configuration so long as a reduction in an amount of sensed light occurs when an accumulation of ink occurs. As the accumulation of ink increases in size the amount of light sensed will decrease. Consequently, the sensor arrangement can be configured to generate an indication that there is a reduction in light sensed, and hence likely an accumulation of ink present, when a threshold amount of reduction occurs, and the threshold amount can be adjustable. Alternately, or in addition, the amount of light sensed can be continuously displayed, etc. Any manner of alerting an operation can be implemented. Although the sensor is described herein with respect to a single nozzle inkjet printer, it will be apparent that the disclosed invention can also be applied to systems with multiple nozzles, including dual nozzle, multi-nozzle, and binary array systems.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A continuous ink jet print head, comprising:

an ink droplet generator configured to emit ink droplets along a droplet flight path;

a charge electrode configured to impart a charge to at least some of the ink droplets;

at least one deflector plate adjacent the droplet flight path, downstream from the charge electrode, and configured to deflect at least some of the ink droplets to a deflected droplet flight path;

a gutter configured to receive ink droplets not intended for printing; and an ink buildup sensor configured to detect an accumulation of ink on a print head surface via a change in an amount of light sensed by the ink buildup sensor.

2. The continuous ink jet print head of claim 1, wherein the ink buildup sensor comprises a light detector and a light emitter, wherein the light emitter and the light detector are configured such that the accumulation of ink reduces an amount of emitted light that is detected by the light detector.

3. The continuous ink jet print head of claim 2, wherein the ink buildup sensor is configured to detect the accumulation of ink on an internal surface of the print head that is downstream of the deflector plates and external to an interior of the gutter.

4. The continuous ink jet print head of claim 2, wherein the ink buildup sensor is configured to detect the accumulation of ink on an internal surface of the print head adjacent an inlet of the gutter.

5. The continuous ink jet print head of claim 2, wherein the gutter is positioned between the light emitter and the light detector such that the accumulation of ink on an external surface of the gutter is effective to reduce the amount of emitted light that is detected by the light detector.

6. The continuous ink jet print head of claim 3, wherein the ink buildup sensor comprises a housing comprising a light emitting end and a light detecting end, wherein light emitted by the light emitter is emitted from the light emitting end in a direction generally transverse to the undeflected droplet flight path and is gathered by the light detecting end and delivered to the light detector.

7. The continuous ink jet print head of claim 6, wherein the light emitter emits light into an emitter transparent cover disposed in the light emitting end, wherein the emitter transparent cover reflects the emitted light toward a sensor transparent cover disposed in the light detecting end, and wherein the sensor transparent cover reflects the light emitted from the emitter transparent cover and directs it toward the light detector.

8. A continuous ink jet printing system, comprising the continuous ink jet print head of claim 1 and a controller in signal communication with the ink buildup sensor and configured to generate a signal indicative of the change in the amount of light sensed by the ink buildup sensor.

9. A continuous ink jet print head, comprising:

an ink droplet generator configured to emit an ink droplet along an undeflected droplet flight path;

a charge electrode configured to impart a charge to the ink droplet;

deflector plates adjacent the undeflected droplet flight path and configured to deflect the ink droplet to a deflected droplet flight path that lies within a range of deflected flight paths;

a gutter configured to receive an ink droplet traveling along the undeflected droplet flight path; and an ink buildup sensor comprising a light detector, the ink buildup sensor configured to infer an accumulation of ink that grows in a direction toward an ink droplet in flight on the deflected droplet flight path by sensing a reduction in light received by the light detector.

10. The continuous ink jet print head of claim 9, wherein the ink buildup sensor is configured to generate a signal indicative of the reduction of the light received by the light detector.

11. The continuous ink jet print head of claim 10, wherein the ink buildup sensor is configured to generate an alarm signal when the signal indicative of the reduction of the light indicates a reduction in the light that exceeds a threshold value.

12. A continuous ink jet printing system, comprising the continuous ink jet print head of claim 10 and a controller in signal communication with the ink buildup sensor and configured to generate an alarm when the signal indicative of the reduction of the light indicates a reduction in the light that exceeds a threshold value.

13. The continuous ink jet print head of claim 9, wherein the light detector comprises an image detector.

14. The continuous ink jet print head of claim 9, wherein the ink buildup sensor comprises a light emitter disposed on an opposite side of the gutter than the light detector.

15. The continuous ink jet print head of claim 14, wherein the ink buildup sensor comprises at least one reflecting surface configured to reflect light emitted from the light emitter.

16. A continuous ink jet printing system, comprising:

an ink droplet generator configured to emit an ink droplet along an undeflected droplet flight path;

a gutter comprising a gutter opening aligned with the undeflected droplet flight path;

an ink buildup sensor comprising a light detector disposed in a light detector location, wherein an amount of light at the light detector location varies as ink builds up on the gutter, and wherein the light detector is configured to detect a variation in the amount of light; and a controller in signal communication with the ink buildup sensor.

17. The print head of claim 16, wherein the controller is configured to generate an alarm signal when the amount of light detected by the light detector falls below a threshold value.

18. The print head of claim 16, wherein the controller is configured to determine a rate of growth of the in buildup, wherein the controller is configured to estimate when a size of the buildup will exceed a threshold value, and wherein the controller is configured to convey to an operator when the size of the buildup will exceed the threshold value.

19. The print head of claim 16, wherein the ink buildup sensor further comprises a light emitter, and wherein the light emitter and the light detector are disposed on opposite sides of the gutter.

20. The print head of claim 19, wherein the ink buildup sensor comprises at least one reflecting surface configured to reflect light emitted from the light emitter.

21. The print head of claim 16, wherein the light detector comprises a linear array or an image sensor.

* * * * *